US010292473B2

(12) United States Patent
Meersschaert

(10) Patent No.: US 10,292,473 B2
(45) Date of Patent: May 21, 2019

(54) LUGGAGE HANDLE

(71) Applicant: Samsonite IP Holdings S.a r.l., Luxembourg (LU)

(72) Inventor: Reinhard Meersschaert, Merelbeke (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

(21) Appl. No.: 15/715,763

(22) Filed: Sep. 26, 2017

(65) Prior Publication Data

US 2018/0084883 A1 Mar. 29, 2018

(30) Foreign Application Priority Data

Sep. 26, 2016 (EP) ..... 16190705

(51) Int. Cl.

| | |
|---|---|
| ***A47B 95/02*** | (2006.01) |
| ***A45C 13/26*** | (2006.01) |
| ***A45C 5/14*** | (2006.01) |
| ***A45C 13/28*** | (2006.01) |

(52) U.S. Cl.

CPC ..... *A45C 13/262* (2013.01); *A45C 5/14* (2013.01); *A45C 13/28* (2013.01)

(58) Field of Classification Search

CPC . Y10T 16/455; Y10T 16/451; Y10T 16/4554; Y10T 16/513; A45C 13/26; A45C 13/22; A45C 13/262; A45C 13/265; A45C 13/267; A45C 13/28; A45C 5/14; A45F 5/10; A45F 5/1026

See application file for complete search history.

(56) References Cited

U.S. PATENT DOCUMENTS

| | | | | | |
|---|---|---|---|---|---|
| 3,464,586 | A | * | 9/1969 | Hitzeroth | A47J 37/0871 220/763 |
| 4,364,150 | A | * | 12/1982 | Remington | A45C 13/26 16/409 |
| 4,544,050 | A | * | 10/1985 | Seynhaeve | A45C 13/262 190/115 |
| 4,561,526 | A | * | 12/1985 | Winter | A45C 13/262 16/113.1 |
| 4,653,142 | A | | 3/1987 | Upton | |
| 5,068,944 | A | * | 12/1991 | Knurr | A45C 13/26 16/438 |
| 5,330,037 | A | * | 7/1994 | Wang | A45C 5/14 16/113.1 |

(Continued)

FOREIGN PATENT DOCUMENTS

| | | | |
|---|---|---|---|
| CA | 2175291 | A1 | 1/1997 |
| CN | 201039807 | Y * | 3/2008 |

(Continued)

OTHER PUBLICATIONS

Extended European Search Report of European Patent Application No. 16190705.0 dated Feb. 15, 2017, 4 pages.

*Primary Examiner* — Chuck Y Mah

(74) *Attorney, Agent, or Firm* — Dorsey & Whitney LLP

(57) ABSTRACT

A luggage carry handle assembly for a luggage case is provided. The handle assembly may include a recessed region positioned on the top side of the luggage case, and a carry handle movably mounted to the recessed region on top of the case. The carry handle moves pivotally relative to the recessed region and the luggage case.

15 Claims, 10 Drawing Sheets

(56) References Cited

U.S. PATENT DOCUMENTS 5,355,980 A * 10/1994 Hsieh ..... A45C 5/14 16/113.1
5,533,601 A * 7/1996 Wang ..... A45C 13/22 150/108
5,560,458 A * 10/1996 Franklin ..... A45C 5/14 16/113.1
5,573,089 A * 11/1996 Liang ..... A45C 5/14 190/115
5,943,936 A * 8/1999 Deliman ..... A45C 13/262 16/113.1
5,975,606 A * 11/1999 Forbes ..... B60N 3/023 16/421
6,338,400 B1 * 1/2002 Wu ..... A45C 13/262 16/113.1
6,345,414 B1 2/2002 Chieh-Chiung
6,575,493 B1 * 6/2003 Lowenstein ..... A45C 5/14 190/18 A
6,938,741 B2 * 9/2005 Hsien ..... A45C 5/14 190/102
6,948,601 B1 9/2005 Fisher
6,978,514 B2 12/2005 Kuo et al.
7,097,181 B2 8/2006 Sadow
7,114,602 B2 10/2006 Chen
7,232,018 B1 * 6/2007 Salander ..... A45C 5/14 190/103
8,333,271 B2 12/2012 Gibson
2005/0183914 A1 * 8/2005 Lin ..... A45C 13/262 190/115
2008/0093828 A1 * 4/2008 Kim ..... A45C 13/262 280/655.1
2011/0209960 A1 9/2011 MacLean, III et al.
2012/0126500 A1 * 5/2012 Rankin ..... A45C 5/14 280/47.2
2013/0284553 A1 10/2013 Daniels et al.
2014/0124317 A1 * 5/2014 Santy ..... A45C 5/14 190/115
2016/0135563 A1 * 5/2016 Truong ..... A45C 13/262 16/113.1
2017/0127783 A1 * 5/2017 Korey ..... A45C 5/03
2018/0000215 A1 * 1/2018 Korey ..... A45C 13/28

FOREIGN PATENT DOCUMENTS

CN 201480303 U 5/2010
CN 204378177 U 6/2015
EM 003395508-0001 9/2016
GB 2111465 A 7/1983
GB 2290952 A 1/1996
JP 3203641 U 4/2016
WO WO-03041528 A1 * 5/2003 ..... A45C 13/26
WO 2003/041528 A1 5/2013
WO 2014/177863 A1 11/2014

* cited by examiner

LUGGAGE HANDLE

CROSS-REFERENCE TO RELATED APPLICATION

This application claims priority to European Patent Application No. 16190705.0, filed Sep. 26, 2016, entitled "Luggage Handle", which is hereby incorporated by reference herein in its entirety for all purposes.

TECHNICAL FIELD

The present disclosure relates generally to luggage articles, and more specifically to an improved carry handle arrangement of a luggage case.

BACKGROUND

Luggage articles often include carry handles on the top surface of the case. The carry handle is typically stationary and positioned near the centerline of the luggage, and thus limits the ability to fully utilize the top area of the luggage. Such carry handles must also be attached to the top side, and the top side of the case strengthened so as to support the weight of the case through the carry handle. This complicates construction, assembly and manufacture of the luggage case, and can add weight, and may also make the stitching operations for attaching the carry handle complicated and costly.

It is therefore desirable to provide an improved luggage article, and more specifically an improved luggage handle assembly, and a luggage case configured with the improved luggage handle assembly, that addresses one or all of the above described problems and/or which more generally offers improvements or an alternative to existing arrangements.

Documents that may be related to the present disclosure in that they include various carry handles include CA2175291, GB2290952, JP3203641U, U.S. Pat. Nos. 8,333,271, 7,114,602, 7,097,181, 6,978,514, 6,948,601, 6,345,414, 4,653,142, and US20110209960.

SUMMARY

An improved handle assembly, and a luggage case configured with the improved handle assembly, is disclosed herein that positions the carry handle at a location that has sufficient structure to allow lifting and carrying of the luggage case without significant or any reinforcement of the top side of the luggage case. Additionally or alternatively, the disclosure also allows for a more full utilization of a top side of the luggage case for additional aesthetic and functional features. The mounting of a carry handle in a recessed region at least partially located on a side of a luggage case having sufficient structural strength to allow a user to lift and move the luggage case by the carry handle. In one configuration, the recessed region is formed at least partially on a top side of the luggage case, the top side facing away from a support surface upon which the luggage case is resting. The carry handled is coupled within the recessed region to move, such as by pivoting, between a retracted position and an operative position. The handle assembly may also include a pull handle coupled to the luggage case in the recessed region, with both the carry handle and the pivot handle being accessible to a user. The mounting of the carry handle in the recessed region, such as alongside the pull handle in the housing structure, utilizes the existing structure for supporting the pull handle to also support the load created by lifting or moving the luggage case by the carry handle. This configuration is beneficial because it allows for a single handle assembly to be used in constructing a luggage case, which saves on inventory, time and expense. A further advantage is that the carry handle has a low profile relative to the top side of the luggage case when in the retracted position to avoid or lessen the risk of being caught or snagged during luggage handling during travel. The carry handle may also be considered flush in certain arrangements with a top side of the luggage case for further enhancement of its unobtrusiveness.

Additionally or alternatively, this configuration reduces or eliminates the need, and associated expenses, to otherwise reinforce the top side of the luggage case to support the load of the luggage case when lifted by a carry handle not coupled with the recessed region alongside the pull handle. Further additional or alternative benefit is derived because the carry handle, when mounted in the recessed region, may pivot between a storage position where it lays relatively flush with the top side of the luggage case, and an operative position where the carry handle is accessible for use to lift or move the luggage case. The carry handle is thus easily accessible when needed, and can be stowed out of the way when not needed. Separately, the mounting of the carry handle in the recessed region alongside the pull handle also creates a larger useable area on the top side of the luggage case for possible use to include other aesthetic features or functional features, such as for instance a top compartment may be positioned in the useable area. Each of these benefits or advantages may be realized individually or in various combinations, by practicing the disclosure made herein.

In one arrangement, a handle assembly for a luggage case includes a housing structure defining a recessed region having side walls and mountable at least partially in a side of the luggage case. In one example the side is the top side of the luggage case, which is opposite the bottom side upon which the luggage case rests when set on a support surface. A pull handle is mountable within the housing structure and has a hand grip. A carry handle has a grip portion and an arm portion extending from the grip portion, and the arm portion is pivotally coupled to the housing structure. The grip portion is movable between a first position proximal to the top side of the luggage case and a second position distal to the top side of the luggage case, and is accessible by a user. The first position near the top side provides a low profile, even flush profile in some instances, to avoid accidentally catching or snagging the carry handle during luggage handling. The second position allows for the handle to be positioned with sufficient clearance from the luggage case to allow the user to effectively grip and lift or move the luggage case.

In another arrangement of the handle assembly, there may be more than one arm portion extending from the grip portion. Having more than one arm is advantageous because it distributes the load of the luggage case when being lifted. For instance, the arm portion extending from the grip portion may include first and second arms extending from the grip portion at spaced apart positions, and optionally the first and second arms may extend from opposing ends of an elongated grip portion. In another arrangement, the first and second arms are coupled to respective side walls, and optionally the first and second arm portions are pivotally coupled to respective sidewalls. In another arrangement, the pivot coupling slides relative to the housing structure. In another arrangement, the at least one arm portion is angled relative to the top side of the luggage case when in at least one position, such as in the retracted position. In another arrangement, the grip portion may be positioned in alignment with the hand grip of the pull handle or out of alignment with the hand grip of the pull handle.

In a further arrangement, the pivotal coupling defines a pivot axis, and the pivot axis extends through an extension path of the extendable pull handle. In another arrangement, the carry handle may optionally pivot about the pivot axis and the grip portion may be positioned in the extension path of the pull handle. These configurations provide a familiar weight distribution for the user for lifting the case, regardless if the pull handle or carry handle are utilized. In one arrangement, the pull handle includes at least one extendable tube, wherein the at least one tube is coupled to the housing structure, or to the housing structure and to the bottom side, or to the housing structure and the rear side, or to just the bottom side, or to just the rear side. In one arrangement, the pull handle is at least partially extended and the carry handle rests against the pull handle but remains accessible, and may rest against the tube or tubes of the pull handle. Further, the grip portion of the carry handle may rest against the pull handle, or the tube or tubes of the pull handle, and remain accessible even though the pull handle is extended.

In another arrangement, the grip portion defines at least one flat surface to create a flush profile or a low profile relative to the top side of the luggage case when in the retracted position. In another arrangement, in the first position the grip portion is adjacent to or abuts the housing structure, or is adjacent to or abuts the top side to create a flush profile or a low profile relative to the top side of the luggage case. In another arrangement, the carry handle is biased to the first position to maintain the carry handle in the low profile or flush configuration.

In another arrangement, a luggage case is provided that includes the handle assembly as provided above in the various arrangements, and further optionally may include a bottom side positioned opposite the top side. Optionally, wheels may be positioned on the bottom side. In one arrangement, the luggage case is at least partially constructed of soft side material. Soft side luggage construction is generally lightweight and preferred by many travelers. In a further arrangement, the luggage case may include a frame, and wherein the housing structure is coupled to the frame. Coupling the housing structure to the frame enhances the strength of the housing compartment to handle the weight of the luggage case when the carry handle is used to lift or move the luggage case. In another embodiment, the pull handle includes at least one extendable tube, wherein the at least one tube is coupled to the housing structure and to the bottom side, or to the housing structure and to a rear side. These coupling configurations provide stable support for the housing structure when the carry handle is used to lift or move the luggage case. In another arrangement, the pivot coupling on the luggage case slides towards a center of gravity of the luggage case when moving from the retracted position to an operative position. Moving the carry handle towards the center of gravity better aligns the weight of the luggage case for convenient carrying by the user. In another embodiment, the luggage case may include a top compartment located on the top side of the luggage case. A top compartment provides additional storage for the convenience of the user.

In yet another arrangement, a handle assembly for a luggage case has a top side, a rear side, and wheels, the handle assembly including a recessed region having side walls and positioned at least partially in the top side of the luggage case, a pull handle coupled in the recessed region and a carry handle having a grip portion and first and second arms coupled in the recessed region by a coupling system. The coupling system is configured to movably couple the first and second arms within the recessed region, wherein the first and second arms are angled relative to the top side when in the retracted position. The angled position of the arms relative to the top side aid in the carry handle having a low profile relative to the top surface when in a retracted position to reduce the risk of the carry handle being caught or snagged, and possibly damaged, during handling while of the luggage, such as by an airport luggage system.

In another arrangement the first and second arms are coupled to respective side walls of the recessed region. In another arrangement, the coupling system includes a first coupling feature formed on the first arm, a second coupling feature formed on an adjacent one of the side walls, and wherein the first and second coupling features are movably engaged together. This provides for a joint structure between the carry handle and the recessed region that allows movement of the grip portion relative to the top side of the luggage case, and/or relative to the recessed region.

In another arrangement, the recessed region is formed in a bezel structure, and the bezel structure is coupled to the luggage case. The bezel structure may provide an enhanced strength to the coupling of the carry handle to the luggage case. In a further arrangement, the coupling system is aligned along an axis that passes through an extension path of the extendable pull handle. This alignment allows for a common axis upon which the luggage case is lifted, and thus a familiar weight distribution for the user, whether by the carry handle, or by a partially extended pull handle.

In another arrangement, the first coupling feature is a boss, the second coupling feature is an aperture, and the boss is rotatably received in the aperture to form a pivot structure. In another arrangement, the pivot structure defines a pivot axis. In another arrangement, the pivot structure is stationary, which is advantageous for providing a robust coupling to the bezel structure. In another arrangement, the pivot structure slides along a sliding path formed in the bezel structure. In a further arrangement, the sliding path is configured to limit the handle from pivoting in the retracted position but allows the handle to pivot once it is slid out of the retracted position into a partially or fully operative position. The sliding path may allow for increased spacing between the grip portion and the top of the luggage case, for enhanced ease of access.

In another arrangement, the grip portion is positioned outside of the recessed region when the handle is in a retracted position. In another arrangement, the luggage case is of soft-sided material with a frame structure at least partially supporting the bezel structure. This benefits the strength of the bezel structure to support the weight of the luggage case when moved or lifted by the carry handle.

In another arrangement, the pull handle includes at least one extendable tube, with the at least one tube coupled to the housing structure, or to the bottom side, or to the housing structure and to the bottom side, which may provide adequate strength for lifting or moving the luggage case buy the carry handle, especially in soft side or hybrid luggage cases.

Additional arrangements, examples and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which form a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various examples of the disclosure and should not be construed as a complete recitation of the scope of the disclosure, characterized in that.

DETAILED DESCRIPTION

As provided herein, a handle assembly is provided, and a luggage case configured with the handle assembly is provided, wherein the handle assembly may include an extendable pull handle and a pivotable carry handle that are mounted within a recessed region formed at least partially in the top side of a luggage case, such as in a housing structure. The carry handle may pivot between an operative position to allow a user to manipulate the luggage while on its wheels or lift the luggage, and a retracted position where it maintains a low profile and allows access to the pull handle. The pull handle is extendable and allows a user to tow the luggage along on its wheels, making it easier to move the luggage longer distances. The carry handle and the pull handle may each couple to the luggage article within the recessed region, which helps leave much of the top side of the luggage case unused compared to where a carry handle is mounted outside of the recessed region. For instance, in one example an optional recessed compartment or pocket may be integrated within the top side of the luggage article with more room provided for by using a pivotable carry handle mounted near the pull handle, such as in the recessed region, instead of being mounted in a central region on the top side of the luggage article.

Figure 1:
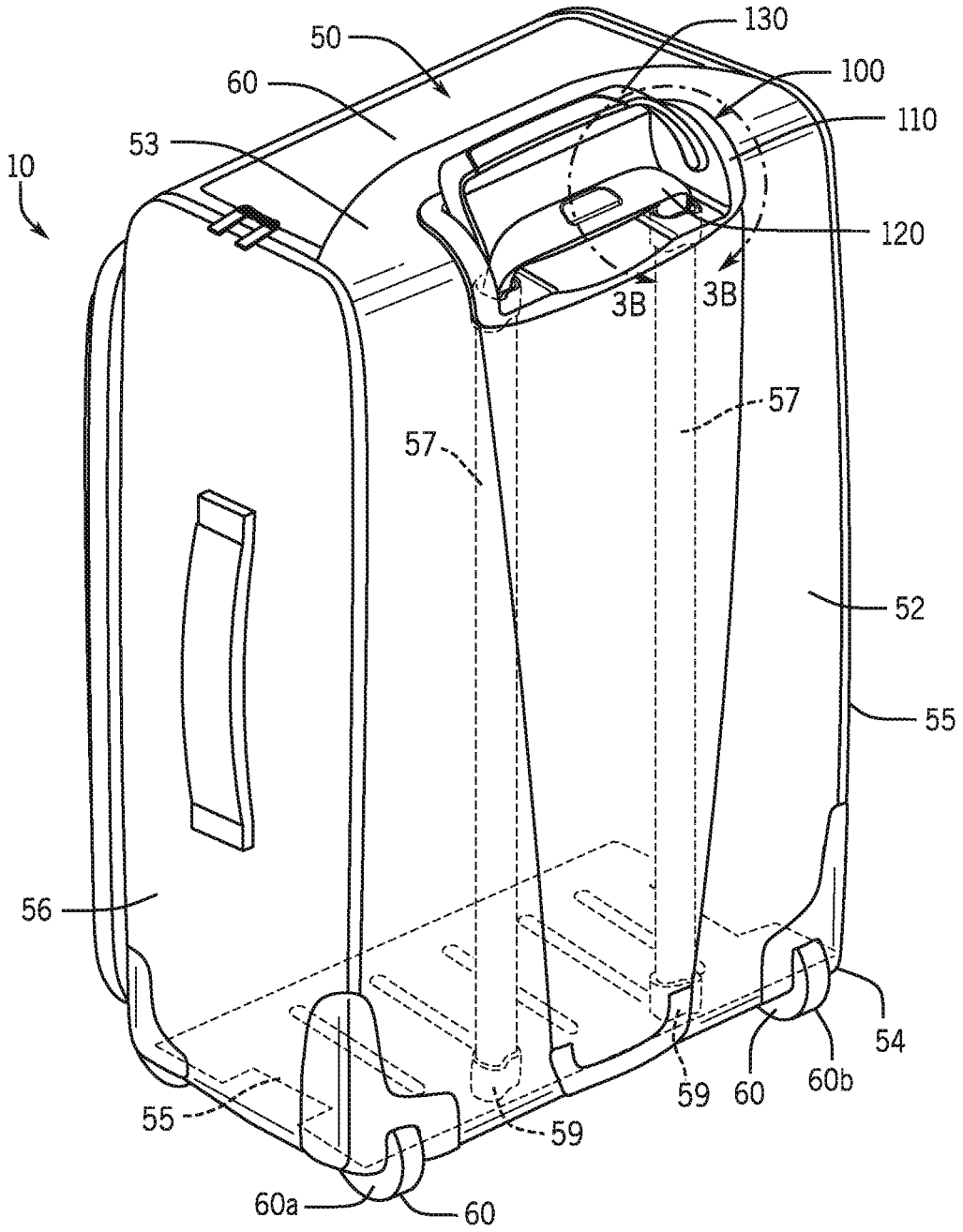
FIG. 1 is a rear isometric view of a luggage case including a carry handle and pull handle assembly in accordance with some examples of the present disclosure.

Referring to FIG. 1, a luggage case 50 according to an example of the present disclosure includes a luggage article having a handle assembly 100 positioned within a recessed region 117. The recessed region 117 is located at the intersection between the top wall 53 and the rear wall 52, and may be at least partially formed on the top side of the luggage case. In some examples and as described further below, the recessed region 117 may be formed by a housing structure 110 or other frame structure, which is secured to the luggage case. In such examples, the housing structure 110 may be located at the intersection between the top wall 53 and the rear wall 52 and positioned there to provide suitable access to the handle assembly 100 for manipulation of the luggage case 50. The handle assembly is positioned on a top wall 53 adjacent the intersection with the rear wall 52.

Figure 4:
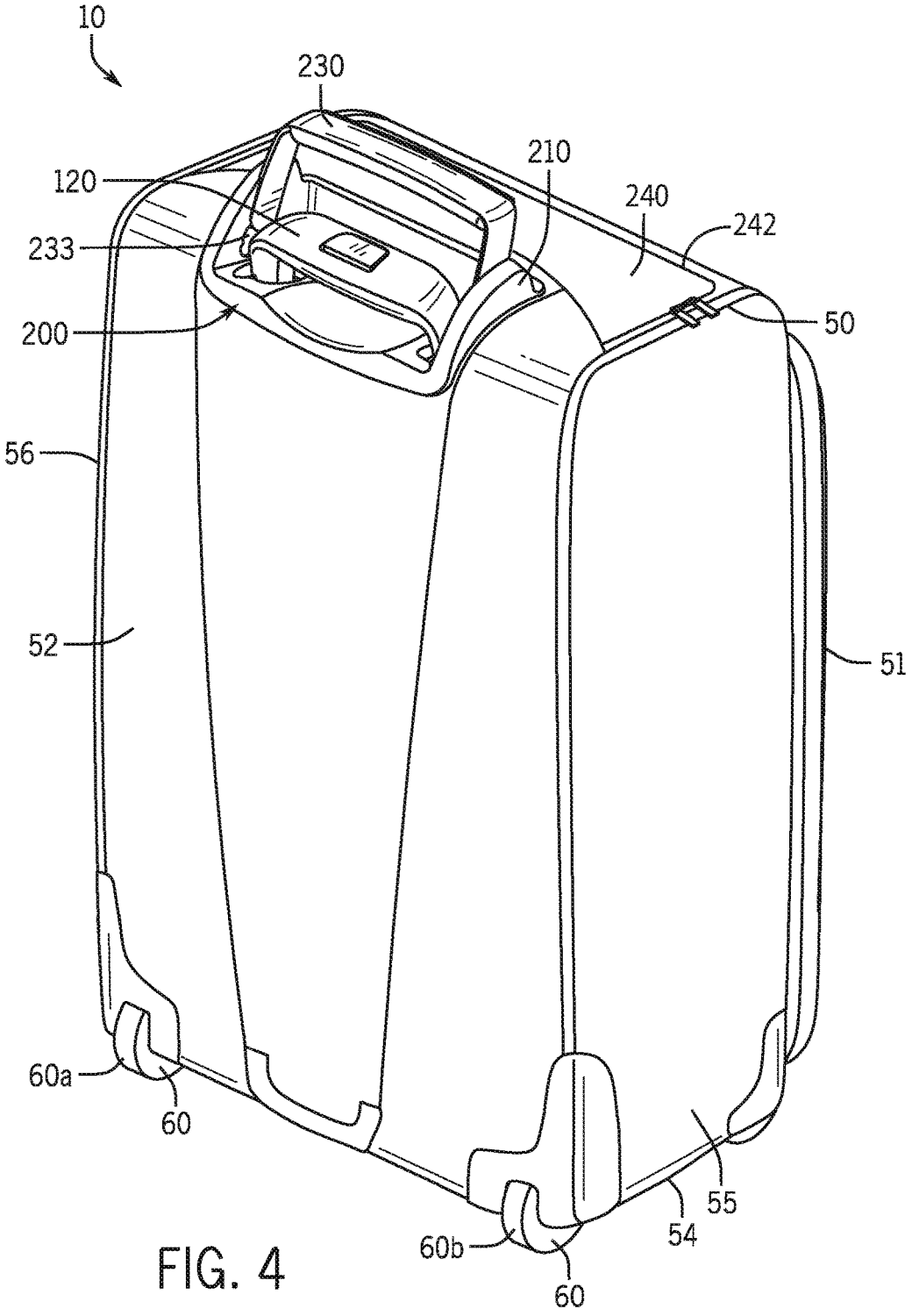
FIG. 4 is a rear isometric view of a sliding carry handle and pull handle on a luggage case in accordance with some examples of the present disclosure.

Referring to FIGS. 1 and 4, the luggage article 10, according to an example of the present disclosure, includes a luggage case 50 formed from a plurality of walls or panels defining an internal compartment and a storage volume in which to carry a user's belongings. As shown, the luggage case 50 includes opposing front and rear sides or panels 51, 52, opposing top and bottom sides or panels 53, 54, and opposing left and right sides or panels 55, 56 that collectively define the outer structure of the luggage case 50. The opposing front and rear sides or panels 51, 52 may define major faces of the luggage article 10, with the top, bottom, left, and right sides or panels 53, 54, 55, 56 forming minor faces. As shown in FIGS. 1 and 4, at least one wheel assembly 60 may be coupled to the luggage case 50, typically on the bottom side 54. For example, the luggage case 50 may include two wheel assemblies 60*a*, 60*b* coupled to at least the bottom side 54. The wheel assembly 60 may include a plurality of attachment structures operable to receive fasteners or corresponding structure defined within or on the luggage case. More wheel assemblies may be utilized. Where the luggage case is of soft sided construction, a bottom tray structure 55 (FIG. 1) may be included and coupled with the bottom side to provide support for the attachment of the wheel or wheels thereto. In one example, the top side of the luggage case is opposite the bottom side upon which the luggage case rests when set on a support surface. The recessed region may be positioned on any side of a luggage case as may be desired.

The luggage case 50 may be substantially any type of luggage article (e.g. bag, case, rollable backpack, etc.), though in the preferred example the luggage case 50 is an upright case having wheels 60. In such examples, the luggage case 50 includes other features for convenience, such as a base 58 and a lid 59 pivotably coupled to the base 58. As indicated above, the telescoping pull handle 120 may be extendable from a rear of the luggage case 50 such that the pull handle 120 can be used to pull and/or wheel the luggage case 50 on the wheels 60 by a user.

In accordance with various examples, the recessed region 117 may be formed on soft sided, hard sided, hybrid, or other types of luggage cases. The luggage case 50, which forms the interface, may be moldable hard side material, soft side material, or a combination of hard side material and soft side material (hybrid). The soft side material may be nylon, canvas, polyester, leather, PVC, polypropylene, polyethylene, and/or PTFE, among others, in combination or not, and may be one layer or several layers. The soft-sided luggage structure may include a frame structure made of elongated members, such as wire members, pulltrusion members, coupled together using connector elements, or may be made of panel members constructed of stiffened sheet materials (such as honeycomb or polypropylene board) or wire loop frame elements, or a combination of the above. The hard side material may be a thermoplastic material (self-reinforced or fiber reinforced), ABS, polycarbonate, polypropylene, polystyrene, PVC, polyamide, and/or PTFE, among others. In hybrid or hard sided examples, the luggage case 50 or a portion thereof may be formed or molded in any suitable manner, such as by plug molding, blow molding, injection molding, or the like.

In a hard sided luggage case having a hard sided structure, or a hybrid case with a hard top pan or top shell, the recessed region may be formed into the molded material forming the hard sided structure. In a soft sided luggage case made of a soft sided material, the recessed region 117 may be formed in the exterior surface and at least partially supported by the frame structure of the soft sided luggage case.

The handle assembly 100 may include a telescopic pull handle 120 and a carry handle 130, as shown in FIG. 2A-2D. The telescopic pull handle 120 and the carry handle 130 may be at least partially coupled to a portion of the recessed region 117, and in one example to a portion of the housing structure 110. The telescopic pull handle 120 is coupled to the luggage case in the housing structure. The coupling of the pull handle to the luggage case creates a strong structure that can support both carrying or wheeling the luggage case using the pull handle. For instance, in one example, the pull handle may include at least one extendable tube 57, which is positioned along the rear face 52 of the luggage case 50 (and may be coupled therealong by fasteners) and is coupled to the bottom side 54 of the luggage case. In one example a lower end of tube 57 may be secured to the bottom tray 55, such as by being received in an upstanding collar 59 and fixed therein. Other suitable coupling structures are contemplated. The pull handle may also be coupled to the housing structure 110, such as by the at least one tube being received through a collar formed about an aperture positioned in the bottom wall housing structure 110. The pull handle 120 is extendable and retractable from the recessed region 117, and is optionally positioned interior to the luggage case. The carry handle 130 is pivotably mounted to portions of the recessed region 117, such as being pivotally mounted to opposing end walls or side walls of the recessed region. The pivotal mounting of the carry handle within the recessed region allows it to pivot between a retracted position and an operative position relative to the top of the luggage case 50.

In accordance with various examples, as illustrated in FIGS. 2A-3C, the carry handle 130 may be coupled with and selectively movable relative to the recessed region 117. In particular, and in a non-limiting example, the carry handle may pivot relative to the recessed region about a pivot axis, or may have a compound motion where the carry handle pivots relative to at least one pivot axis and also translates, slides, rotates or twists relative to the recessed region. By coupling the carry handle in the housing structure, such as in one example along with the pull handle, the load created by lifting and/or moving the luggage case, whether by the carry handle or the pull handle are concentrated at a strong load-bearing region of the luggage case. This simplifies the construction of the luggage case, whether it is hard sided, soft sided or hybrid, since the top side of the luggage case does not need to be reinforced to support the luggage case being lifted and/or moved by a carry handle mounted to the top side outside the housing structure. The construction of the luggage case may also simplified because the handle assembly is a single unit and includes the desired handle(s), such as in one example the carry handle and the pull handle, for more convenient mounting during construction. Additionally or optionally, the positioning of the carry handle in the housing structure leaves a large area of the top side available for other desired structures, such as a top compartment, which is described further below.

In accordance with various examples, in the retracted position the carry handle 130 is positioned so as to allow full access to the telescopic pull handle 120, and may also be substantially flush with the housing structure 110. In an operative position the carry handle 130 is pivoted to extend generally upright relative to the top side 53 of the luggage case 50 to allow a user to grasp the handle 130 to lift the luggage case. The handle assembly may include the carry handle 130 individually, the extendable pull handle 120 individually, or both the carry handle and the extendable handle.

In some examples, and with reference to FIG. 2A-3C, the handle 130 may include a central grip portion 139 and at least one arm portion 132. The at least one arm portion 132 may extend perpendicularly from the grip portion. The at least one arm portion 132 also may include an example having spaced apart first and second arms 132*a*, 132*b*, extending from, at, or adjacent to opposing ends of the elongated grip portion 139. In other examples, the grip portion may be coupled to the luggage case via a single arm, such as one extending from the grip portion of the handle a single side of the housing structure. In accordance with various examples, the elongated grip portion 139 may include a top surface 156 and a bottom surface 154, with the bottom surface forming a rounded contour configured for engagement by a user's fingers and/or palm, and a top surface 156 including less of a contour than the bottom surface 154, and which contour may have at least in part a generally flat shape or planar shape. The width of the grip portion 139 and each of the arms 132*a, b* may be defined by an inner edge 152 and an outer edge 150. The outer edge 150 of each arm 132*a, b* may shorter than the inner edge 152 of each arm 132*a, b* because the grip portion 139 extends between the arms 132*a, b* with the top surface 156 at an angled position relative the length of each arm 132*a, b*. The top 156 of the grip portion 139 faces generally directly away from the top side 53 of the luggage case when in the retracted position, thus having a flush or low-profile contour relative to the top side, and may be positioned at an angle to the top side of the luggage case in an operative position.

The recessed region 117, in one example, may be formed in a housing structure, with the housing structure mounted to the luggage case. In accordance with various examples discussed herein, the housing structure may be a molded plastic insert that is attachable to the luggage case 50, and forms a mounting bracket for at least partially coupling the handle assembly to the luggage case 50. The mounting structure may in particular be a bezel structure 110 as shown throughout, that acts as a mounting bracket suitable to secure the extendable tow handle 120 and the carry handle 130 to the luggage case 50. In various examples, the housing structure 110 may provide direct or indirect support for these structures. For example, the housing structure 110 may include one or more channels or apertures 125 positioned to receive the telescopic portion of the pull handle 120. In accordance with alternative examples, the carry handle 130 may be movably coupled with the housing structure 110 alone without the pull handle, but otherwise consistent with the examples, examples, and structures discussed herein. Where the recessed region 117 is formed in a housing structure, with the housing structure mounted to the luggage case, the housing structure may be made of a semi-rigid formable material, such as plastic, and secured or coupled to the luggage case. In a hard sided luggage case the housing structure may be mounted or coupled in a recess formed in the hard sided structure. In a soft sided luggage case, the housing structure may be mounted or coupled to the frame and integrated into the outside surface of the soft sided luggage case. In a hybrid luggage case made of both soft sided and hard sided components, the recessed region may be configured in either manner noted above depending on the structure surrounding the location of the recessed region.

As illustrated in FIGS. 2A-3C, the housing structure 110 (and also in the more generic form, the recessed region 117) may define interior walls forming the recessed region 117. For example, as shown in FIGS. 2A-2D, the housing structure 110 may have opposing interior side walls 114*a*, 114*b* separated by housing structure back wall 114*c* and housing structure bottom wall 114*d*. Together the walls 114*a*, 114*b*, 114*c*, and 114*d* define the recess 117 in the housing structure 110. Additionally and optionally, a rim 118, which in one example is an outward extending flange, may extend from the top edge of at least a portion of the housing structure walls and overlaps the top side 53 of the luggage case adjacent the location of the housing structure. The rim 118 provides a finished appearance for the housing structure, and generally conforms to the outer surface of the luggage case to reduce possible snags when handling. The housing structure periphery 158 is formed by the upper edge of the walls 114*a-d*, and may be a continuous periphery. The portion of the periphery 158 associated with the back wall 114, and the portion of the periphery 158 associated with the bottom wall 114*d*, may form engagement surfaces against which the carry handle rests in various positions.

In one example, the handle 130 may be moved at least between a first (e.g. retracted) position (shown in dash in FIG. 2A) where the grip portion is proximal to the top side of the luggage case, and a second position (e.g. an operative position, shown in solid in FIG. 2A) where the grip portion is distal to the top side of the luggage case and accessible by a user for gripping. In an operative position, the grip portion extends above the housing structure. The carry handle may also move to additional positions, such as position intermediate the first and second position, as described below.

In the retracted position, the carry handle engages or abuts the housing structure 110, or may abut the top side 53 of the luggage case, or may abut both. In one example, the inner edge 150 of the at least one arm portion 132 engages the housing structure 110 at or near the periphery 158. In this position, the length of the at least one arm portion 132 extends at an angle to the top side 53 of the luggage case, and generally the grip portion extends above the recessed region 117 and at least a portion of the grip portion 139 may extend laterally beyond the periphery of the 158 of the housing structure 110. The bottom surface 154 of the grip portion 139 may at least partially abut the housing structure 110, and in one example may at least partially abut, engage, couple with or rest upon the rim 118 of the housing structure 110 as shown in FIG. 2C. The rim 118 in this example is formed by a flange, which overlays the top side 53 of the luggage case around at least a portion of the periphery of the housing structure 110. In the retracted position, at least a portion of the grip portion 139, such as the bottom surface 154, may couple with the top side 53 of the luggage case. The top surface 156 of the grip portion 139 may be generally parallel with the top side 53 of the luggage case to create a relatively flush and low profile. The top surface 156 may also be at an angle to the top side 53 of the luggage case and still be considered to maintain a low profile. In the retracted position the grip portion 139 is positioned relatively close to the topside 53 of the luggage case but is accessible to allow a user to engage the grip portion 139 and move it to other orientations.

In another example, the housing structure 110 may be widened (such as wall 114*c* being lengthened in reference to FIG. 2F), or the arm portion 132 may be shortened, to allow the carry handle 130 to move to a first (e.g. retracted) position where it is fully or almost fully received within the recessed region 117 of the housing structure 110. In this example, the grip portion 139 is flush with, or below flush with, the top side 53 of the luggage case 10, and is considered as having a low profile relative to the top side 53 of the luggage case. In this example, the top surface 156 is at an angle to the top side 53 of the luggage case, but still creates a low profile because it is received within the recessed region 117. The top surface 156*a* (in dash) may also be relatively parallel to the top side 53 of the luggage case, and still be considered to create a low profile. In the retracted position shown in FIG. 2F, the grip portion 139 is accessible to allow a user to engage the grip portion 139 and move it to other positions. This configuration would continue to provide the advantages of the housing structure 110 shown in FIGS. 2A-2E, including the common location of the carry handle 130 in the handle assembly as referenced above. Additionally, the benefits of allowing a top compartment and having a sufficient access gap Y (See FIG. 2B) may still be realized.

Figure 2A:
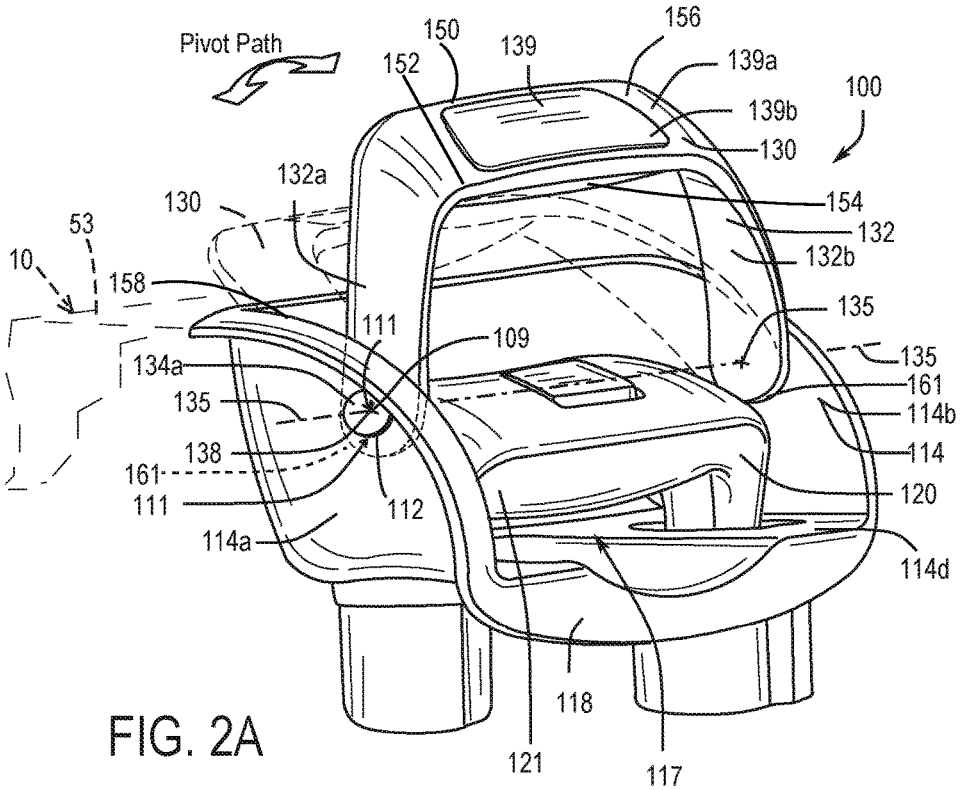
FIG. 2A is a rear isometric view of the handle assembly of FIG. 1 with the carry handle moving into an operative position in accordance with some examples of the present disclosure.
Figure 2B:
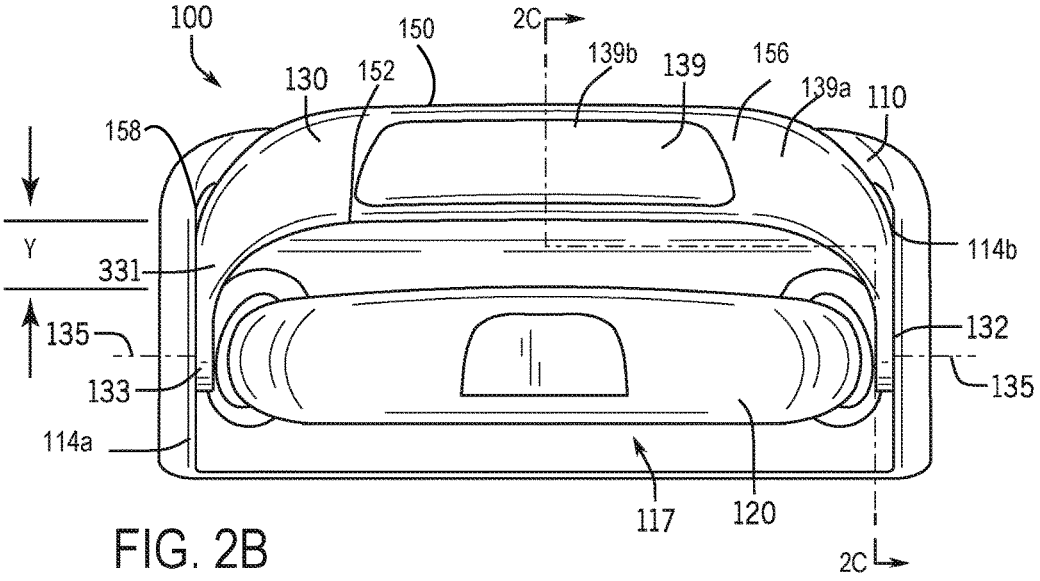
FIG. 2B is a top view of the handle assembly of FIG. 1 with the carry handle in a retracted position in accordance with some examples of the present disclosure.
Figure 2C:
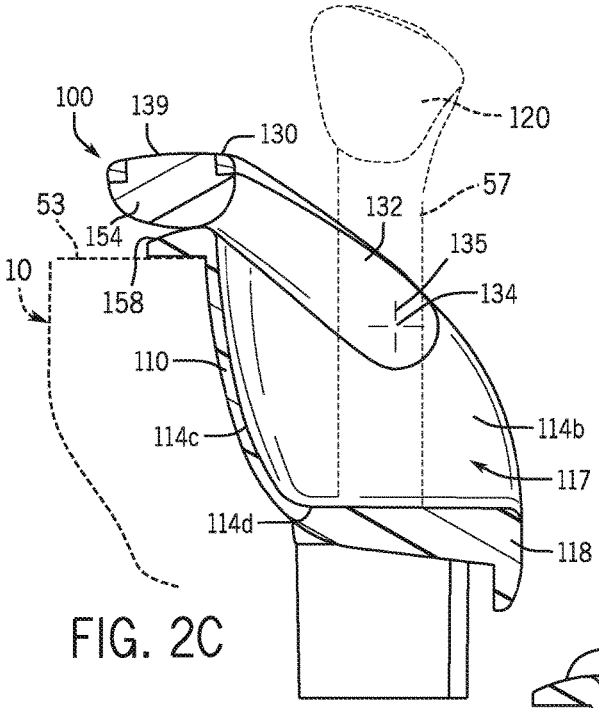
FIG. 2C is a side elevation view of the handle assembly of FIG. 1 taken along cross-section line 2C-2C shown in FIG. 2B with the carry handle in a retracted position in accordance with some examples of the present disclosure.
Figure 2D:
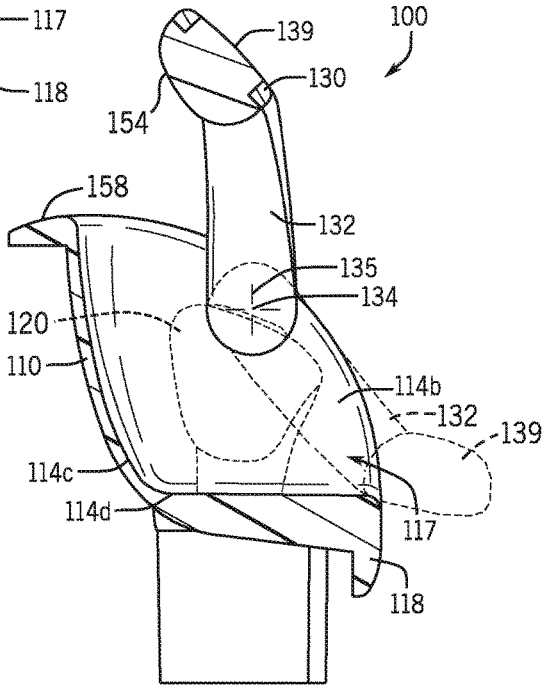
FIG. 2D is a side elevation view of the handle assembly of FIG. 2C with the carry handle in an operative position in accordance with some examples of the present disclosure.
Figure 3A:
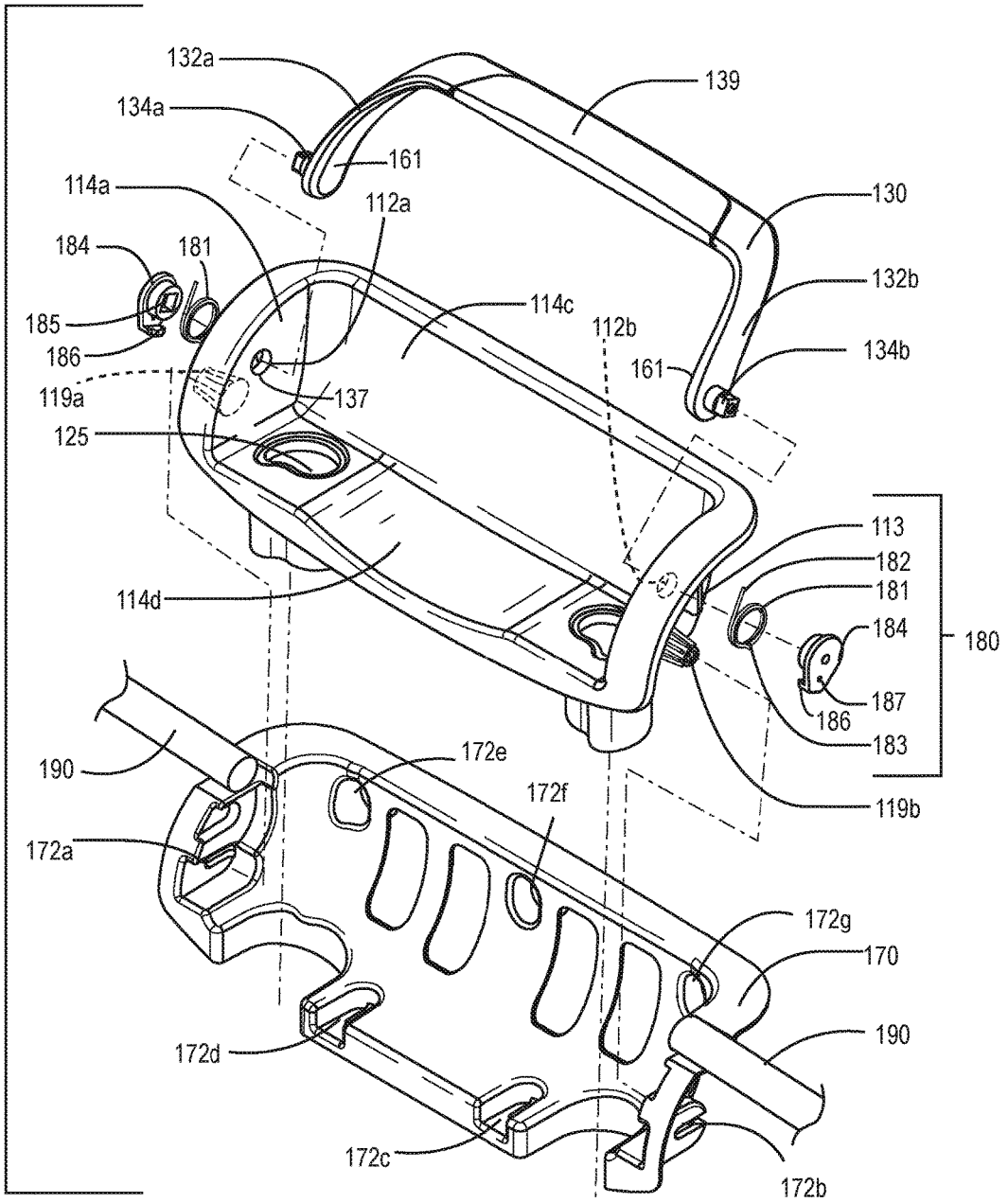
FIG. 3A is a rear isometric exploded view of the handle assembly of FIG. 1 as shown having a housing structure and a frame support in accordance with some examples of the present disclosure.
Figure 3B:
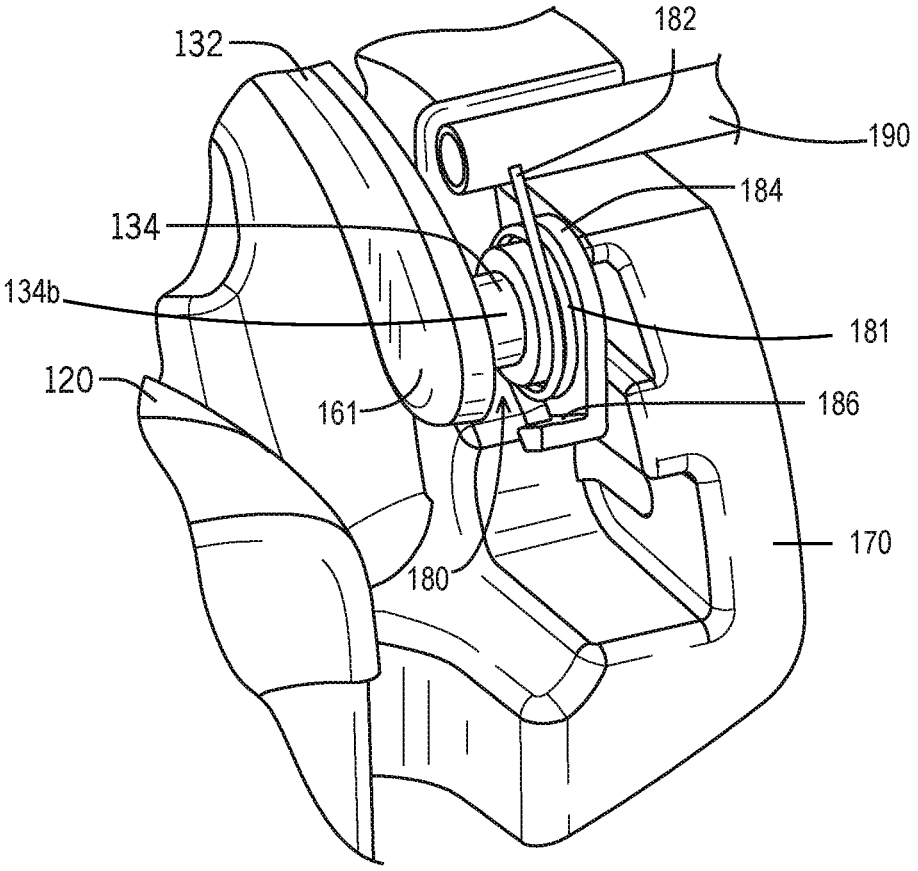
FIG. 3B is a detailed view 3B-3B of a biasing mechanism of a handle of FIG. 1 having the housing structure removed to show a pivot structure, biasing mechanism, and a frame support in accordance with some examples of the present disclosure.
Figure 3C:
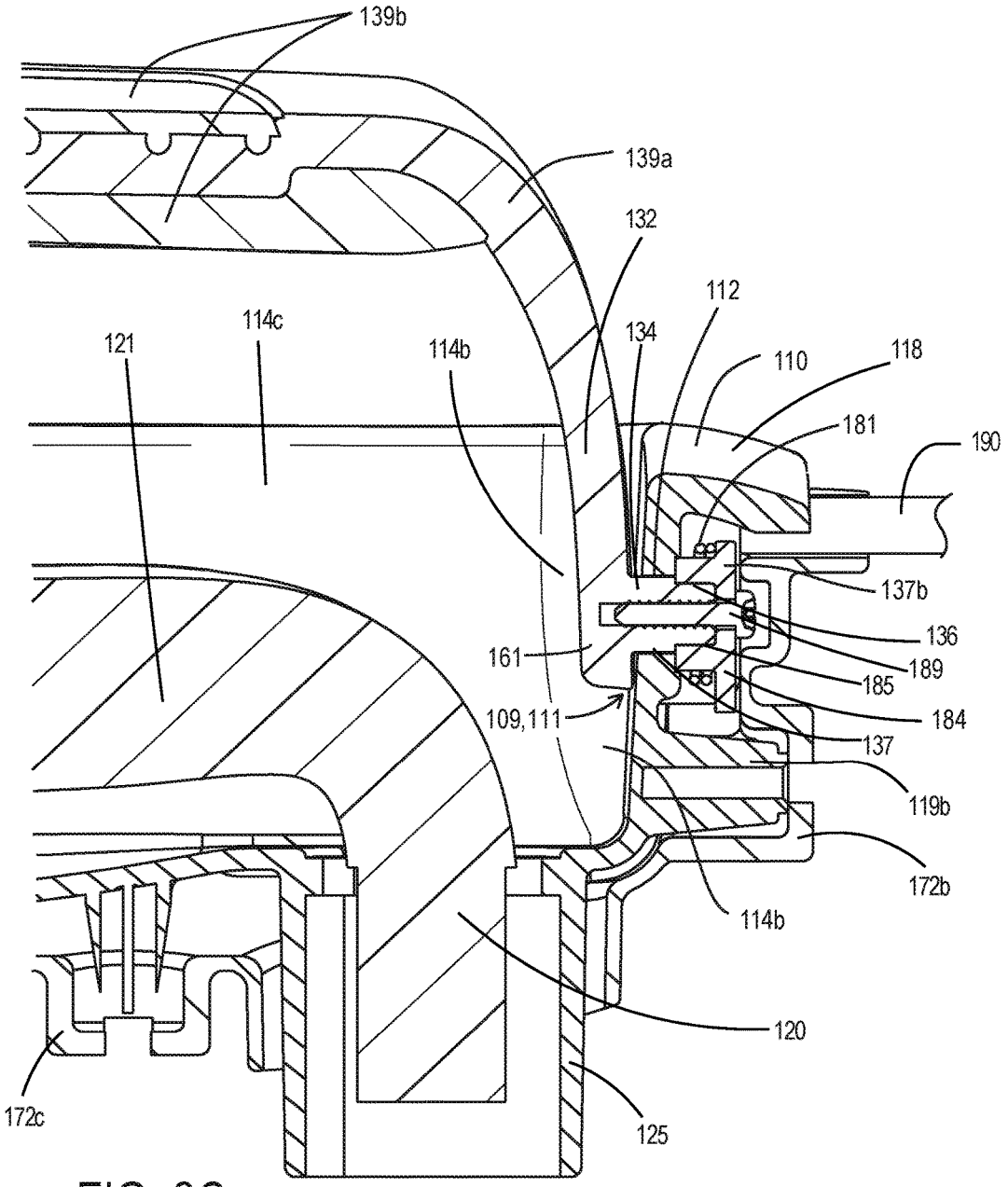
FIG. 3C is a cross-section view of the luggage handle assembly of FIG. 1 taken along detailed section line 3C-3C as shown having a housing structure and a frame support in accordance with some examples of the present disclosure.

In an operative position shown in FIG. 2A, the handle 130 extends nearly directly upwardly relative to the housing structure 110 (and thus the top surface), with the at least one arm portion 132 in a generally vertical position (see e.g. FIGS. 2A, 2D, 3C). In accordance with various examples, the arms 132*a* and 132*b* of the handle 130 may be sufficiently long such that the grip portion 139 of the handle 130 is able to pivot to a position over the telescopic pull handle 120 when the telescopic pull handle 120 is in a retracted position and the carry handle 130 is in an operative position. In an operative position, the top surface 156 of the grip portion 139 is angled relative to the top side 53 of the luggage case, and away from the luggage case towards the rear major side 52 (e.g. outwardly). In this orientation, a user may grasp the grip portion 139 with the user's palm engaging the inner side of the grip portion 139. The handle 130 may rotate further away from the top side 53 of the luggage case, such as in one example, to an external position towards the peripheral edge 159 associated with wall 114*d*, where the grip portion 139 is located close to the rear side, and may extend beyond the rear side. See the dashed position of the carry handle 130 in FIG. 2D. This orientation may be helpful to reposition a luggage case that is resting on its front side, such as when it is on a luggage conveyor belt. In some examples, the handle 130 may be biased toward the retracted position, an operative position, or the external position, by a bias structure, such as a spring. An operative position includes many positions where the carry handle can be grasped and used to move, lift, or otherwise manipulate the luggage case.

Figure 2E:
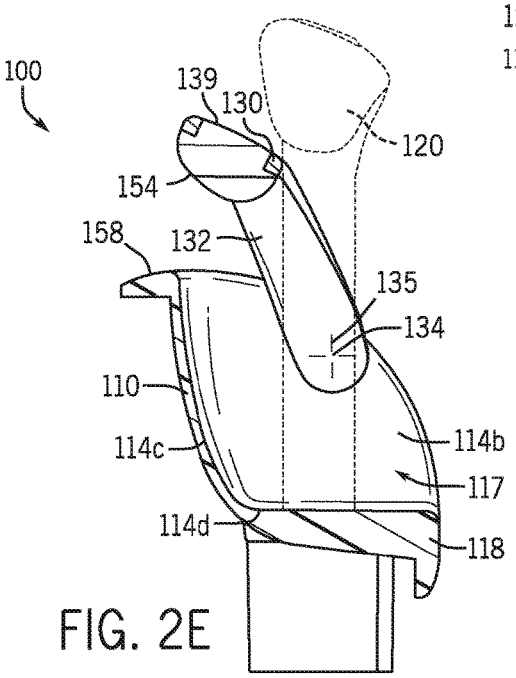
FIG. 2E is a side elevation view of the handle assembly of FIG. 2C with the carry handle in an intermediate position and resting against the pull handle in an operative position.
Figure 2F:
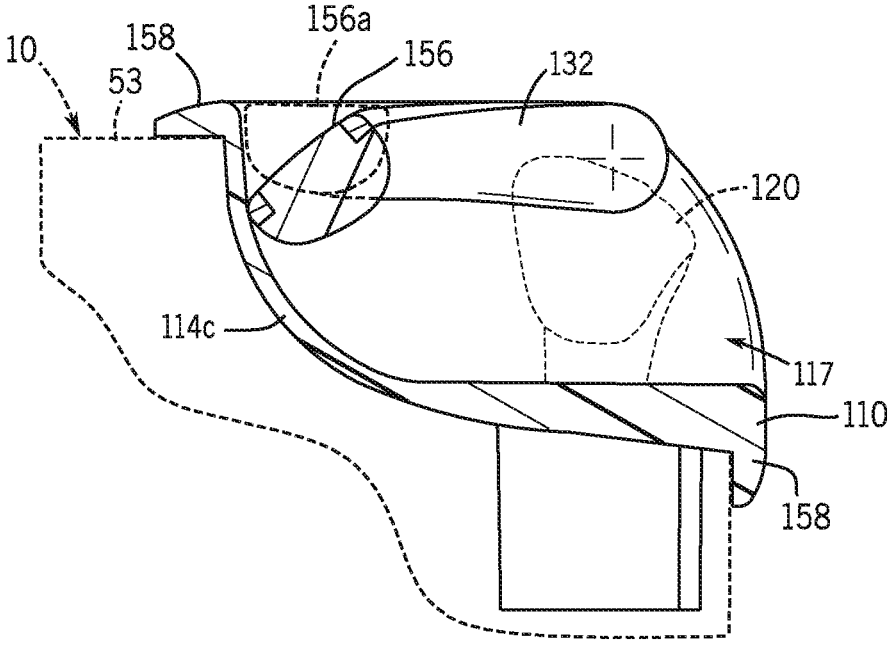
FIG. 2F is a side elevation view similar to the handle assembly of FIG. 2C with the housing structure enlarged, and the carry handle in the retracted orientation, and the carry handle being at least partially flush with, and having a low profile with respect to, the periphery of the housing structure.

There may be additional positions taken by the carry handle, such as an intermediate position between the first and second positions, where the carry handle is pivoted upwardly from the first position and into contact with the tubes of the extended pull handle, such as is shown in FIG. 2E, where the carry handle is easily accessible. In this position the user may utilize either of the pull handle or carry handle as desired. One such instance is when transitioning from pulling the luggage case along a support surface using the pull handle and then temporarily grasping the carry handle to lift the luggage over an obstacle (e.g. a curb) without having to retract the pull handle. The benefits of the carry handle being accessible and pivotally movable between different positions, including an operative position, when not in the retracted position are or may be separately advantageous from the relatively flush and low profile benefits when in the retracted position. The flush and low profile features of the retracted carry handle are separable from, or combinable with, the movement of the carry handle between accessible positions when not retracted.

As the handle 130 pivots between the retracted and operative positions, the arms 132*a, b* move about a coupling assembly 111, formed between the carry handle and the housing structure 110. In one example, a coupling assembly 111 may be in the form of a pivot coupling 109 (also referred to as a pivot structure) structure as shown in FIGS. 2A-2D, which in this case is formed by the engagement of the coupling feature on the arms 132*a, b* and the corresponding coupling feature on the opposing sidewalls 114*a* and 114*b* of the housing structure 110. The pivot structure 109 forms a pivot axis 135 about which the arm portion 132 pivots. The movement structure may also allow compound movement as noted above, and disclosed below relative to another example. Separately or together, the lateral and vertical location of the pivot structure on the housing structure walls effects the position of the pivot axis 135 of the carry handle. The particular lateral location may adjust the location of the handle 130, and thus the pivot axis 135 relative to the center of gravity of the luggage case. Additionally, the pivot structure may be vertically located between the peripheral rim 158 of the housing structure 110 and the floor of the housing structure 110.

Continuing with reference to FIGS. 2A-2D, the pivot structure and the axis 135 may be positioned within the recess 117 such that as the handle 130 is rotated it reaches a preferred ergonomic position relative to at least one of the recessed region 117 or the telescopic handle 120. For example, the pivot structure may be positioned on the side walls of housing structure 110 closer to the open side of recess 117 than the back wall 114*c*. In another example, the pivot structure may be positioned on the side walls of housing structure 110 closer to the back wall 114*c* of recess 117 than the open side of recess 117. In another example, the pivot structure may be positioned on the side walls of housing structure 110 such that the handle 130 is approximately in line with the telescopic handle 120 and/or the path of extension of the telescopic handle 120. The pivot axis 135 of the carry handle 130, being defined by the pivot structure, may be positioned in the housing structure 110 as noted above. In one example, the axis of rotation 135 is positioned to be substantially in or near the plane defined by the path of extension of the pull handle 120. The axis of rotation 135 may be positioned so as to pass through the fully retracted hand grip of the pull handle 120, or may be positioned to extend above the fully retracted hand grip 121 of the pull handle 120. In this position, the handle 130 is able to pivot around the pivot axis 135 such that in the upright operative position, as shown in FIGS. 2D and 3C, the handle 130 is positioned above and is generally aligned with the pull handle 120. The pivot axis 135 allows the carry handle 130 to pivot about the axis. The pivot structure may be configured to be stationary, or may be movable, such as by translating along a defined path, as described below.

In accordance with various examples, the handle 130 may have a sufficient separation from the telescopic handle 120 in the retracted position to allow a user to insert a hand between the two handles to grasp either handle. For example, as shown in FIG. 2B, the luggage handle assembly 100 may include an access gap Y between the telescopic handle 120 and the handle 130. The access gap Y may be sufficiently large for a user to grab the telescopic handle 120 or the handle 130 when the telescopic handle 120 and the handle 130 are both in retracted states. The access gap Y may be present in examples when the handle 130 resides fully within the recess 117 in the retracted state or when the handle 130 resides at least partially outside the recess 117 in the retracted state (e.g. when the handle grip 139 is above the housing structure 110 and positioned toward the center line of the luggage case 50 as shown in FIG. 2C.) Additionally, when the carry handle is resting against the extended pull handle, the grip portion is accessible by a user.

FIGS. 3A and 3C show one arrangement of the coupling assembly 111. In this example, the coupling assembly 111 includes a coupling feature 112 associated with the housing structure 110 and a coupling feature 138 associated with the carry handle 130. The housing structure coupling feature 112 and carry handle coupling feature 138, engage together and form a mechanism suitable to allow the handle 130 to move relative to the recess 117 and/or housing structure 110, such as by pivoting or by a compound movement. In various examples, each arm 132*a*, 132*b* may include a coupling feature, e.g. 134*a*, 134*b* (generically 138) to couple with a corresponding coupling feature 112*a*, 112*b* (generically 112) located in the housing structure 110. For example, the coupling feature(s) 138 on each of the arms 132*a, b* may be an outwardly extending boss or bosses 134*a*, 134*b* positioned at, near, or adjacent an end of each of the arms. In various examples, the boss may extend perpendicularly from the respective arm 132*a, b*. The corresponding coupling feature 112 on the housing structure 110 may include a bearing surface 137 to rotatably receive the boss 134*a*, 134*b*. In this example, the coupling features 112*a*, 112*b* are aperture(s) formed in the side walls 14*a, b*. Each aperture is defined by a rim, which forms the bearing surface 137. In this example, a pivot structure is formed by the boss 134*a* being received in aperture 112*a* and engaging rim 137; and likewise by the boss 134*b* being received in aperture 112*b* and engaging rim 137. This engagement of the coupling features of the handle with the housing structure forms the coupling assembly 111 (e.g. specifically, a pivot structure) and rotatably couples the handle 130 to the housing structure 110. Other coupling assemblies are contemplated, such as for one example, where the boss is formed on the housing structure and the aperture is formed on the arm portion 132 of the handle 130, or a separate pivot axle (not shown) extends between apertures formed in the side wall 114 of the housing structure 110 and the arm portion 132 (not shown) of the handle 130. Slots, grooves, detents, pins, collars and other coupling mechanisms may be used to make the coupling assembly.

In some examples, including soft sided, hard sided, or hybrid cases, the housing structure 110 may be attachable to an underlying support structure 170 for connection with the luggage case 50. For example, as illustrated in FIGS. 3A-3C, the housing structure 110 may be attachable to the underlying support structure 170. In one specific example, the underlying support structure 170 is incorporated into a soft-sided luggage case 50 (see e.g. FIGS. 1 and 4). The soft side construction of the luggage case may include a frame structure 190, best shown in FIGS. 3A-3C. The frame structure may include the frame members 190, which may be formed around the at least a portion of the periphery of each of the side walls of luggage case 50 (e.g. side walls 50, 51, 52, and/or 56). A portion of the frame members 190 forming the intersection between the back wall 52 and the top wall 53 may terminate into the support structure 170. As shown in FIG. 3A, the frame members 190 may be sandwiched between the housing structure 110 and the support structure 170, securing the housing structure 110 to the frame 190. The housing structure 110 and the support structure 170 may be connected together via a connection mechanism including sewing, fasteners, glues, or the like. For example, the housing structure 110 may include one or more standoffs (e.g. 119*a*, 119*b*) that are suitable to receive a fastener, such as a screw, that passes through one or more apertures (e.g. 172*a*, 172*b*). As shown in FIG. 3A, the support structure 170 may include apertures (e.g. 172*a*, 172*b*) that correspond with the side walls 114*a* and 114*b* of the housing structure 110, apertures (e.g. 172*c*, 172*d*) that correspond with the bottom wall 114*d* of the housing structure 110, and apertures (e.g. 172*e*, 172*f*, 172*g*) that correspond with the back wall 114*c* of the housing structure 110. The housing structure 110 may have corresponding standoffs or other fastener receiving features for each of the connection apertures. By attaching the support structure 170 and the housing structure 110 together via the fasteners, the frame member 190 is retained between the two, thereby fixedly attaching the housing structure to the luggage case 50.

Optionally, the handle assembly 100, and in particular the carry handle 130 may be secured to the luggage case without the use of a housing structure 110. For instance, where the top side 53 is reinforced sufficiently such as by the internal frame member shown in FIG. 3A-C, or where the luggage case is hard sided, or is of hybrid construction having a hard sided top side or a soft sided top side, the carry handle may be movably coupled to the side walls of the recessed features. The coupling system components, such as the coupling feature 112*a* and 112*b*, may be formed on the underlying support structure 170 in a soft side luggage case.

The carry handle may be moved to the retracted position or another position when unused by a biasing mechanism 180. The biasing mechanism 180 in one example is mounted at or near the coupling mechanism 111, as shown in FIGS. 3A-3C. As shown in this example, the biasing mechanism 180 includes a biasing element 181 that exerts a force on the carry handle 130 to bias the carry handle 130 to the retracted position (as shown in FIG. 3B). For example, the biasing element 181 may be a spring such as a torsion spring received over the center axis of boss 134*b* that exerts a biasing force on the carry handle 130. A first end 182 of the torsion spring 181 may engage a portion of the housing structure 110, such as the flange 113 in FIG. 3A, while a second end 183 of the torsion spring 181 may couple with the carry handle 130, such as through a cap 184 mounted over the keyed end 136 of the boss 134*b*. The cap 184 includes a recess 185 that receives the keyed end 136 so that the cap and boss rotate together. When the carry handle 130 is pivoted or moved from the selected biased position, the second end 183 of the torsion spring moves with the carry handle 130 while the first end 182 of the torsion spring remains fixed, thus loading the spring to increase the biasing force. Once the carry handle is released, the biasing force moves the handle backed to the desired biased position. The position of the torsion spring may be selected such that the handle is biased by the spring force in the retracted position, an operative position or another.

A fastener 189 (e.g. screw, clip, or like fastening mechanism, shown in FIG. 3C) may extend through apertures in each of the cap 184 and the boss 134 connecting them together. The boss at the opposite end of the carry handle may also include a biasing mechanism 180 if desired to apply a greater biasing force if desired.

In accordance with various examples, the cap 184 may also include a limiting tab 186. The limiting tab 186 may extend from the cap 184 such that as the cap 184 rotates with the handle 130, the limiting tab 186 also rotates. A stationary element such as rib 113 from the housing structure 110 may be positioned relative to the limiting tab 186 so that as the limiting tab 186 rotates a desired distance, the limiting tab 186 engages the stationary element thereby limiting or preventing further rotation of handle 130.

In accordance with various examples, the stationary element and the limiting tab are positioned relative to one another such that when the handle 130 is approximately vertical, that tab 186 contacts the rib 113, limiting further movement. In other examples, the tab does not limit rotation until the handle 130 is past a vertical orientation. The carry handle 130 may also rotate to contact the periphery of the housing structure associated with the bottom wall 114*d*.

Figure 5A:
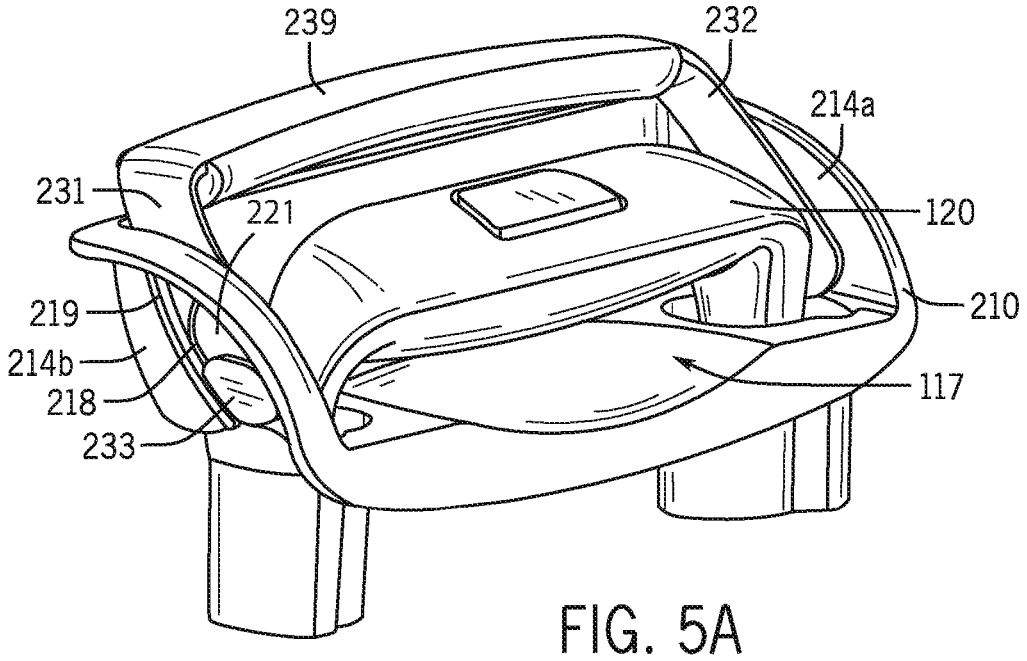
FIG. 5A is a top rear isometric view of the handle assembly of FIG. 4 with the carry handle in a retracted position in accordance with some examples of the present disclosure.
Figure 5B:
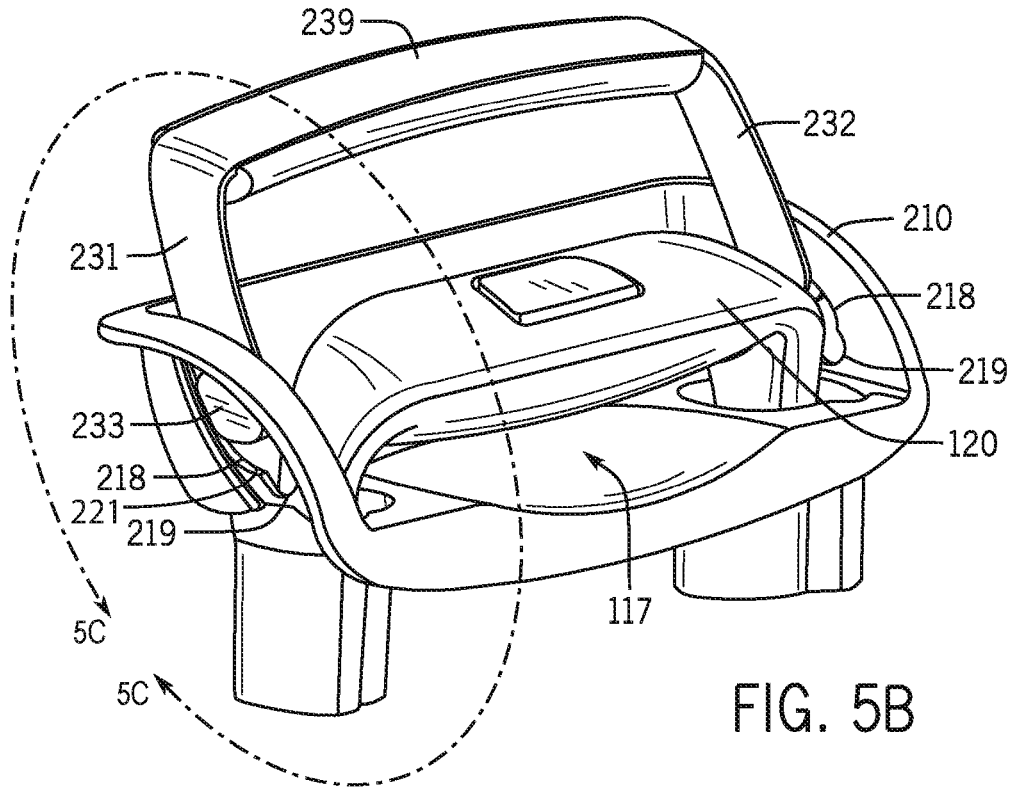
FIG. 5B is a top rear isometric view of the handle assembly of FIG. 4 with the carry handle in an operative position in accordance with some examples of the present disclosure.
Figure 5C:
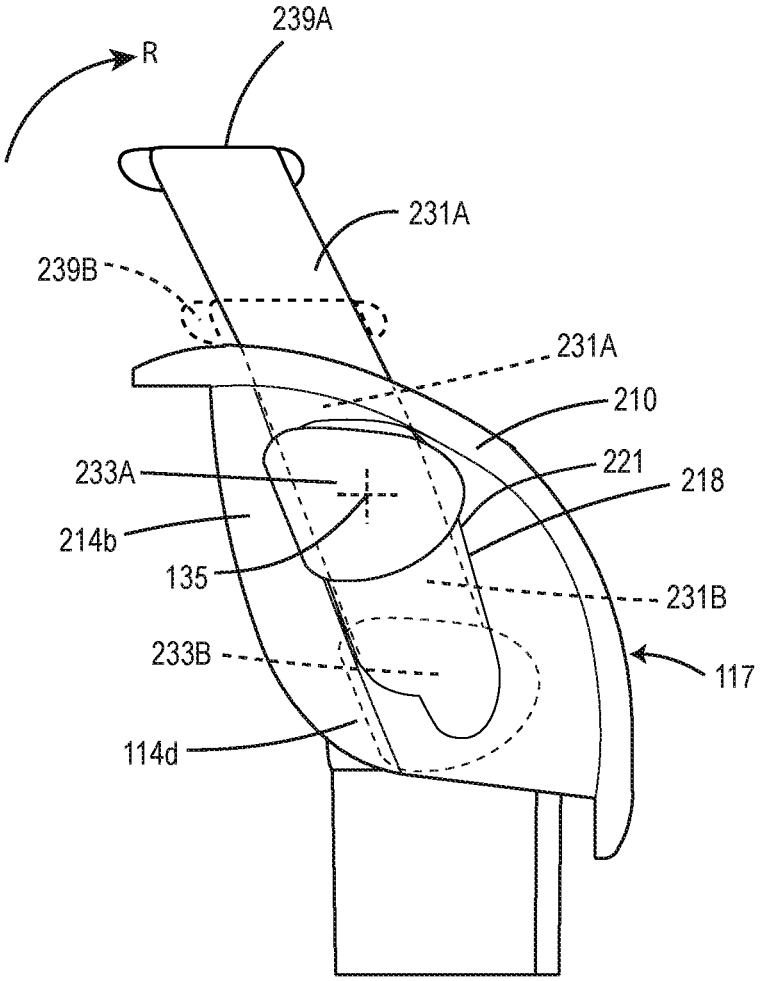
FIG. 5C is a side view of the handle assembly of FIG. 4 with the carry handle in an operative position shown in solid line and retracted position shown in phantom line in accordance with some examples of the present disclosure.

In accordance with various examples, the coupling assembly 111 may include a structure allowing for a compound movement of the handle, such as a combination sliding and pivoting movement as that shown in FIGS. 4 and 5A-C. In such an example, a handle assembly 200 may include a carry handle 230 and a telescoping handle 120 mounted to a housing structure 210. As illustrated in FIGS. 5A-5C, the housing structure 210 may include a path 218 that allows the handle 230 to pivot about a pivot axis, with the pivot axis being able to slide along the path 218 relative to the housing structure 210. As shown in FIG. 5C in particular, the handle and associated grip 239A and arm 231B is shown in a retracted position by the broken line, with the handle and associated grip 239A and arm 231A shown in an operative position. The path 218 may be defined by a slot that is formed through each of the side walls of the housing structure 210. In accordance with various examples, the sliding path 218 may extend in a direction that allows the handle pivot member to move laterally, vertically, or a combination, with respect to the top of the luggage case 50. The sliding slot 221 may allow the handle to move toward the centerline and rise with respect to the top surface 23 of the luggage case while transitioning from a retracted position to an operative position. In conjunction with the ability to pivot, the user is provided a carry handle 230 positioned further above the top surface of the luggage case and more towards the center of the luggage case. The slot 221 may form a path 218 that is curved, linear, or a combination.

In this example, handle 230 may have a coupling feature 233 that interacts with the slot 221 to guide the handle along the slot. The coupling feature 233 may extend from each of the one or more arms of the handle 230 such as arms 231 or 232 and optionally from at or near a terminal end of each arm. The coupling feature 233 may extend through the slot 221 defining the handle pivot path 218. The coupling feature 233 may, at a location outside the wall of the housing structure in which the slot is formed, extend beyond the edges of the slot 221 to inhibit the coupling feature from disengaging from the slot 221. In various examples, the coupling element 233 may be rotatable (such as being pivoted) in at least a portion of the handle pivot path 218. In other examples, the coupling element 233 may be rotatable along the entirety of the pivot path. In one example, the handle does not pivot in the retracted position (e.g. with the grip shown as 239B) but is able to pivot once it is slid out of the retracted position (e.g. with grip shown as 239A). This motion between retracted and operative positions moves the coupling element 233 between these positions as well, with the coupling element 233B shown as a broken line in the retracted position and the coupling element 133A shown as the solid line in an at least partially operative position. The slot 221 defining the pivot path 218 may include a locking element 219 that manipulates the coupling element 233 by limiting rotation of the coupling element 233 when engaged with the locking element. For example, the locking element 219 may be defined by the bottommost portion of the path 218 that includes a slot with a width that is smaller than the width of the topmost portion of the pivot path. (See FIG. 5C.) In this way, the bottom of the path 218 may constrain the coupling element 233 more than the top portion of the pivot path. This may be done to limit rotation of the coupling element, to provide a detent to extension and rotation of the handle, or to better control the handle 230 when in the retracted state. In another examples, the handle pivots along the entire pivot path 218. The handle is suitable to pivot in the direction shown by "R" in FIG. 5C.

The luggage case 50 may include a compartment 150 located on a top side 53 of the luggage, and extending down into, and being separated from, the main storage compartment of the luggage case. The compartment 150 may be accessible through an aperture formed in the top side 53. The aperture may have a plurality of peripheral edges 115 defining a recess in the top side 53 allowing the compartment 150 to be utilized for storage. A flexible or rigid lid 240 may cover the compartment and be selectively openable by a zipper or other fastener 242 securing the cover to the top side 53. In traditional luggage articles, this area is commonly occupied by a carry handle. Providing a carry handle on top of the compartment 150 would, however, may require using the compartment lid as part of the carry handle. However, to fully utilize the top compartment 150, the handle 130 may be incorporated with the luggage handle assembly 100 as discussed above. By providing a pivotably movable handle positioned near the pull handle as discussed above, and in one example in the housing structure with the pull handle, the carry handle does not need to be mounted elsewhere to the top side. This is advantageous for a variety of reasons. For instance, this configuration creates space on the top side to position the top compartment. Another advantage, because the carry handle is not mounted on the top side outside of the recessed area, or mounted on the top compartment, is that the top side outside the recessed area, and/or the top compartment, does not require special reinforcement to support the weight of the luggage case.

All relative and directional references (including: upper, lower, upward, downward, left, right, leftward, rightward, top, bottom, side, above, below, front, middle, back, vertical, lateral, horizontal, and so forth) are given by way of example to aid the reader's understanding of the particular examples described herein. They should not be read to be requirements or limitations, particularly as to the position, orientation, or use unless specifically set forth in the claims. Connection references (e.g. attached, coupled, connected, joined, and the like) are to be construed broadly and may include intermediate members between a connection of elements and relative movement between elements, and may include fixed or releasably engaged relationships. As such, connection references do not necessarily infer that two elements are directly connected and in fixed relation to each other, unless specifically set forth in the claims.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and apparatus and assembly, which, as a matter of language, might be the to fall there between.

The invention claimed is:

1. A handle assembly for a luggage case having a top side, a rear side, and a bottom side opposite the top side, the handle assembly comprising:

a housing structure having side walls defining a recessed region, the housing structure mountable at least partially in the top side of the luggage case;

an extensible pull handle mounted within the housing structure and having a hand grip;

a carry handle having an axis of rotation, a grip portion, and at least one arm portion extending from the grip portion;

wherein the at least one arm portion is pivotally coupled to the housing structure and the axis of rotation of the carry handle is in a plane defined by a path of extension of the pull handle; and wherein the grip portion is rotatable between at least a first position proximal to the top side and a second position distal to the top side and accessible by a user.

2. A handle assembly according to claim 1, wherein the grip portion is elongated and the at least one arm portion extends substantially perpendicularly from the elongated grip portion.

3. A handle assembly according to claim 1, wherein the at least one arm portion is pivotally coupled to at least one of the side walls of the housing structure.

4. A handle assembly according to claim 1, wherein the grip portion may be positioned in alignment with the hand grip of the pull handle in said plane or out of alignment with the hand grip of the pull handle.

5. A handle assembly of claim 1, wherein the at least one arm portion extending from the grip portion comprises first and second arms extending from the grip portion and spaced apart.

6. A handle assembly according to claim 5, wherein the first and second arms are pivotally coupled to respective side walls of the housing structure.

7. A handle assembly according to claim 1, wherein when the pull handle is at least partially extended, the carry handle engages the pull handle but remains accessible by a user.

8. A handle assembly according to claim 1, wherein the grip portion defines a top surface having a flat shape at least in part.

9. A handle assembly according to claim 1, wherein in the first position the grip portion is adjacent to or abuts the housing structure.

10. A handle assembly according to claim 1, wherein the carry handle is biased to the first position.

11. A luggage case having a handle assembly as defined in claim 1.

12. A luggage case as defined in claim 11, wherein the luggage case is at least partially constructed of soft side material.

13. A luggage case as defined in claim 12, wherein the luggage case includes a frame, and wherein the housing structure is coupled to the frame.

14. A luggage case as defined in claim 11, wherein the luggage case includes a top compartment located on the top side of the luggage case.

15. A luggage case according to claim 11, wherein the at least one arm portion is angled relative to the top side of the luggage case in at least one position of the grip portion.

* * * * *